US006912937B2

(12) United States Patent
Tuanmu

(10) Patent No.: US 6,912,937 B2
(45) Date of Patent: Jul. 5, 2005

(54) WRENCH WITH VISUALLY RECOGNIZABLE MECHANISM

(75) Inventor: Tom Tuanmu, Taichung (TW)

(73) Assignee: Lea Way Hand Tool Corporation, Taichung (TW)

( * ) Notice: Subject to any disclaimer, the term of this patent is extended or adjusted under 35 U.S.C. 154(b) by 0 days.

(21) Appl. No.: 10/623,964

(22) Filed: Jul. 21, 2003

(65) Prior Publication Data

US 2004/0149089 A1 Aug. 5, 2004

(30) Foreign Application Priority Data

Jan. 30, 2003 (TW) ..... 92202015 U

(51) Int. Cl.[7] ..... B25B 13/02
(52) U.S. Cl. ..... 81/119; 81/60; 81/DIG. 5
(58) Field of Search ..... 81/119, 60–63.2, 81/52, DIG. 5

(56) References Cited

U.S. PATENT DOCUMENTS 4,280,379 A * 7/1981 Chow ..... 81/62
4,936,170 A * 6/1990 Zumeta ..... 81/180.1
4,947,713 A * 8/1990 Arnold ..... 81/121.1

(Continued)

FOREIGN PATENT DOCUMENTS

| | | |
|---|---|---|
| TW | 77210372 | 11/1977 |
| TW | 77210372 A1 | 1/1979 |
| TW | 77210372 A2 | 2/1979 |
| TW | 88214341 | 8/1988 |
| TW | 77210372 | 11/1988 |
| TW | 77210372 | 1/1990 |
| TW | 77210372 | 2/1990 |
| TW | 91206226 | 5/1991 |

OTHER PUBLICATIONS

*King Tony Hand Tools*, Commercial Catalog for Pusia–Lock Mechanism (2002).

(Continued)

*Primary Examiner*—David B. Thomas
(74) *Attorney, Agent, or Firm*—Ladas & Parry LLP

(57) ABSTRACT

A wrench with visually recognizable mechanism comprises a main body as a handle and wrench heads that are separately connected to two ends of the main body. The wrench heads are capable of tightening or loosening fastening parts with corresponding dimensions. The visually recognizable mechanisms are provided on the main body or the wrench heads, whose appearances assist in distinguishing classification and properties of the wrenches.

10 Claims, 9 Drawing Sheets

U.S. PATENT DOCUMENTS 4,970,917 A * 11/1990 McCollom ..... 81/53.2
4,982,627 A * 1/1991 Johnson ..... 81/121.1
5,079,978 A * 1/1992 Kupfer ..... 81/119
5,181,439 A * 1/1993 Schwartz ..... 81/119
5,330,230 A * 7/1994 Craig ..... 283/81
5,421,224 A * 6/1995 Bond ..... 81/436
5,819,606 A * 10/1998 Arnold ..... 81/124.3
5,957,012 A * 9/1999 McCune ..... 81/180.1
6,047,618 A * 4/2000 Pieri ..... 81/121.1
6,065,598 A * 5/2000 Anderson ..... 206/378
6,082,227 A * 7/2000 Vogel ..... 81/119
6,185,771 B1 * 2/2001 Trusty, Sr. ..... 7/128
6,257,098 B1 * 7/2001 Cirone ..... 81/119
6,269,716 B1 * 8/2001 Amis ..... 81/121.1
6,295,903 B1 * 10/2001 Tipper et al. ..... 81/489
6,490,950 B2 * 12/2002 Ray et al. ..... 76/119
6,609,281 B2 * 8/2003 Morrison et al. ..... 29/227
6,647,833 B1 * 11/2003 Wu ..... 81/63.2
6,651,533 B1 * 11/2003 Hsien ..... 81/60
6,668,751 B1 * 12/2003 Henke ..... 116/200
6,715,382 B1 * 4/2004 Hsien ..... 81/63.2
6,732,614 B2 * 5/2004 Hu ..... 81/63.2
2002/0139224 A1 * 10/2002 Crosser ..... 81/119

OTHER PUBLICATIONS

*FACOM Fi01 Industry*, Commercial Catalog for Power Series Wrenches.

*Asian Sources Hardwares*, Commercial Catalog for Professional HandTool Wrench (May 2002).

*Egamaster S.A.*, Commercial Catalog for Destornilladores/Screwdrivers Tournevis/Handschrauser, M.D. Microtronic and Mastermatic 1 & 2.

*Tradewinds Hardware & Building Materials Buyers' Guide* for Wrench Series and Hand Tools (2001–2002).

*Sears Annual Home, Hardware, Auto and Leisure Annual Catalog for Craftsman®* Wrenches (1988).

*ASAM Outillage Professional* Commercial Catalog for Screwdrivers.

*KS Tools* Commercial Catalog for Wrenches (1997).

* cited by examiner

WRENCH WITH VISUALLY RECOGNIZABLE MECHANISM

BACKGROUND OF THE INVENTION

1. Field of the Invention

The present invention relates to a wrench with visually recognizable mechanism, and more particularly, to a wrench that can be recognized based on visual differences for determining the classifications of various wrenches.

2. Description of the Related Art

For general wrenches, there are differences not only between their application systems, e.g. a metric measuring system and an British measuring system, but also are differences between their combination manners, e.g. an American type and a German type. The sizes of wrenches are further determined by the dimensions of fastening parts for which they are suitable. That is, the specifications of the wrenches with a wide range can be applied to the fastening parts of all dimensions, e.g. from 6 mm to 50 mm and from ¼ inch to 1 and ¼ inch.

Till now, for distinguishing the application or classification of one wrench from others, each one is primarily marked on its main body with identification, e.g. numeric and alphabetical codes. A user can read these identification codes to obtain the wrench whether he needs. Most identification codes are convex or concave characters formed on the main body by machining, or are made during the forging process. Unfortunately, identification codes are the same material and color as the main body so it is hard to recognize them, and often a user only can clearly understand them from a direct front view from a short distance.

Most equipment is assembled by various key components produced in different countries, such as ball screw module made in US and server motors made in Japan. Therefore, regardless of whether they are assembled during production or dismounted during maintenance, it is necessary to repeatedly take one suitable wrench depending on its dimension, specification, or application and return to place. When conventional wrenches are disorderedly piled up, it undoubtedly takes a considerable amount of time to find a suitable wrench again, which is appropriate to use in the meanwhile. Supposedly, there are hundreds or thousands of fasteners or screws in a small-scale machine, and if every time a suitable wrench is taken from a pile of them, there is no way the assembling or dismounting job could be done efficiently and with good quality.

In conclusion, it is a critical issue for the mechanical industry to figure out how to provide a wrench that can be recognized instantly and correctly, because it would certainly reduce the time spent on finding for a adequate wrench, or wasted on picking a wrong one.

SUMMARY OF THE INVENTION

The main objective of the present invention is to provide a wrench with visually recognizable mechanism for identifying its classification so as to make the management and use of wrenches more efficient.

The second objective of the present invention is to provide a wrench based on ergonomic design, not requiring the users to view them from a short distance in order to make correct selection, thus improving the work efficiency.

In order to achieve the objectives, the present invention discloses a wrench with visually recognizable mechanism that can be widely applied on open-end wrenches, speed wrenches, directional-changeable wrenches, and multi purpose wrenches. The wrench comprises a main body as a handle and wrench heads that are separately connected to two ends of the main body. The wrench heads are capable of tightening or loosening fastening parts with corresponding dimensions. The visually recognizable mechanisms are provided on the main body or the wrench heads, whose appearances assists in distinguishing classification and properties of the wrenches.

The visually recognizable mechanism has a designated area on the main body or the wrench head in which colored material is used to represent its classification and properties, or has a concave area on the main body or the wrench head which is attached with a colored ring, a colored block, a sticker, or a display plate, for the purpose of management and classification according to its color identification code.

BRIEF DESCRIPTION OF THE DRAWINGS

The invention will be described according to the appended drawings in which.

PREFERRED EMBODIMENT OF THE PRESENT INVENTION

Figure 1A:
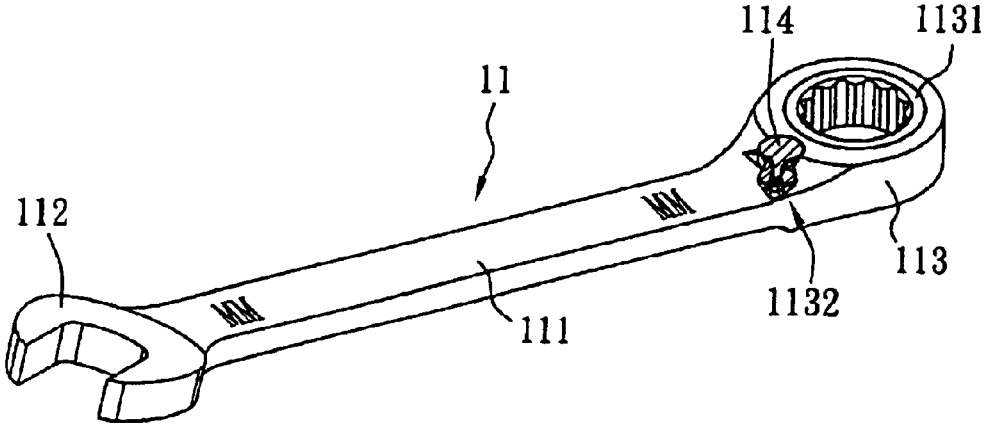
FIGS. 1(*a*)–1(*b*) are a perspective diagram of wrenches with visually recognizable mechanism in accordance with the first embodiment of the present invention.
Figure 1B:
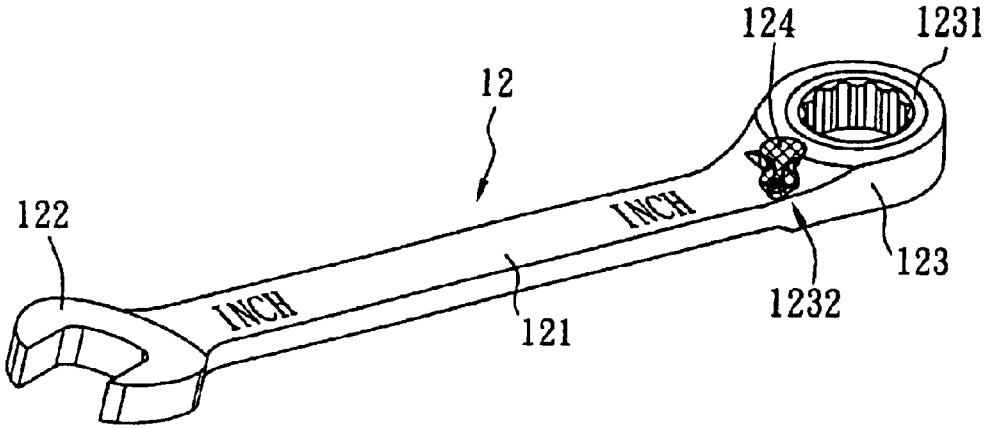
Figure 2A:
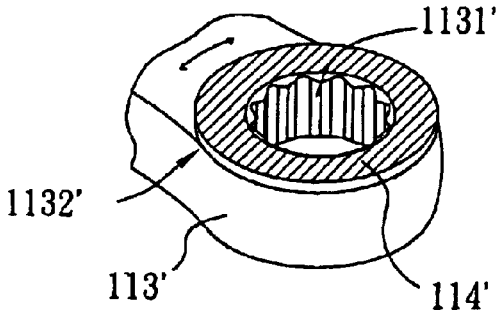
FIGS. 2(*a*)–2(*d*) are a perspective diagram of directional-changeable wrench heads in accordance with the first embodiment.
Figure 2B:
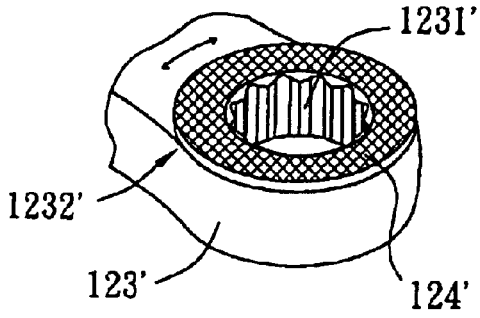
Figure 2C:
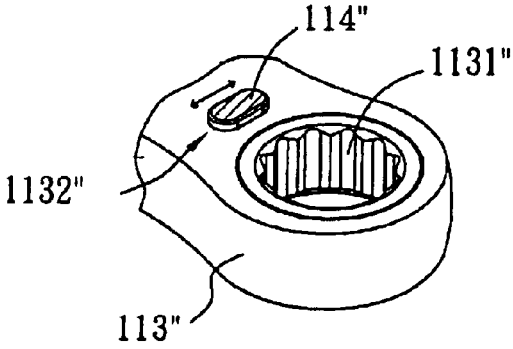
Figure 2D:
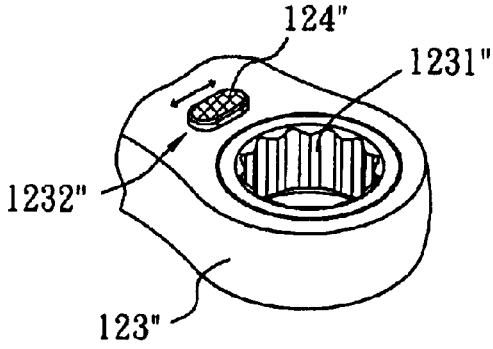

FIGS. 1(*a*)–1(*b*) are a perspective diagram of wrenches with visually recognizable mechanism in accordance with the first embodiment of the present invention. As shown in these figures, wrenches 11 and 12 belong to a type of combination wrenches. That is, a quick reversible wrench head 113 and an open-end wrench head 112 are separately connected to both ends of the handle 111 of the wrench 11, and a quick reversible wrench head 123 and an open-end wrench 122 are separately connected to both ends of the handle 121 of the wrench 12. The quick reversible wrench heads 113 and 123 dividedly have ratchet rings 1131 and 1231 provided on is their centers, and directional-reversible switches 1132 and 1232 are separately provided on the top surface of the quick reversible wrench heads 113 and 123. When the directional-reversible switch 1132 is turned to one direction, the ratchet ring 1131 is allowed of either clockwise rotation or counterclockwise rotation. In order to effectively highlight the application of the wrench 11 for the metric measuring system and the wrench 12 for the British measuring system, visually recognizable mechanisms 114 and 124 are respectively provided on the directional-reversible switches 1132 and 1232, wherein the visually recognizable mechanism 114 is optionally represented by a red mark, and the visually recognizable mechanism 124 is optionally represented by a blue mark. With such an easy way to recognize the marks, it allows the users to quickly obtain the suitable wrenches appropriate for their current jobs.

In addition to the types illustrated in FIGS. 1(*a*)–1(*b*), quick reversible wrenches come in two other common types. As shown in FIGS. 2(*a*)–2(*d*), quick reversible wrench heads 113' and 123' respectively have turning wheels 1132' and 1232' dividedly controlling the rotation directions of their ratchet rings 1131' and 1231', and another type of quick reversible wrenches 113" and 123" respectively have direction buttons 1132" and 1232" dividedly controlling the rotation directions of their ratchet rings 1131" and 1231". The present invention discloses the surfaces of turning wheels 1132' and 1232', which are respectively painted red as a visually recognizable mechanism 114' and painted blue as a visually recognizable mechanism 124', and the surface of directional-reversible switches 1132" and 1232", which are respectively painted red as a visually recognizable mechanism 114" and painted blue as a visually recognizable mechanism 124". Likewise, red represents the metric measuring system, while blue represents the British measuring system.

Figure 3A:
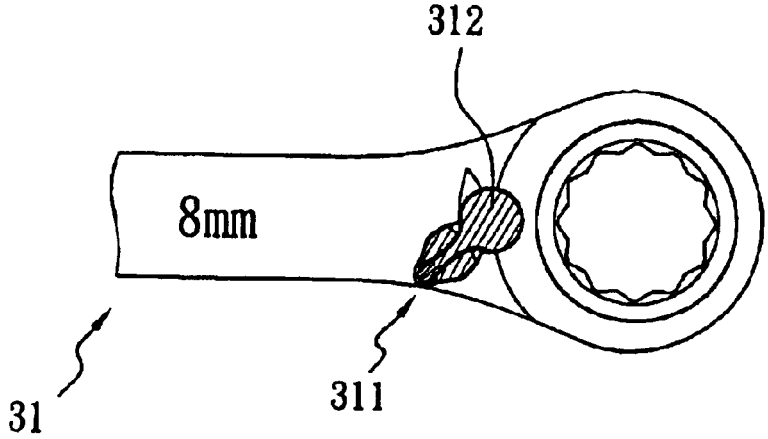
FIGS. 3(*a*)–3(*c*) show top views of direction switches dividedly with visually recognizable mechanism in accordance with the first embodiment.
Figure 3B:
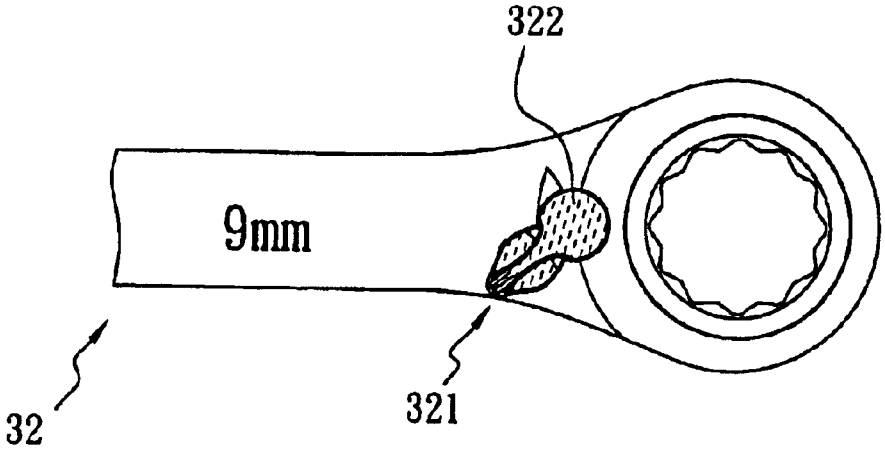
Figure 3C:
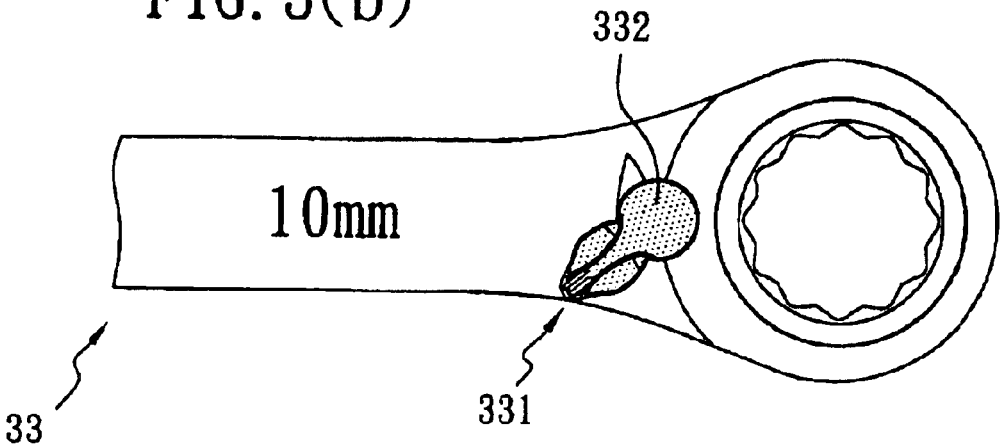
Figure 4A:
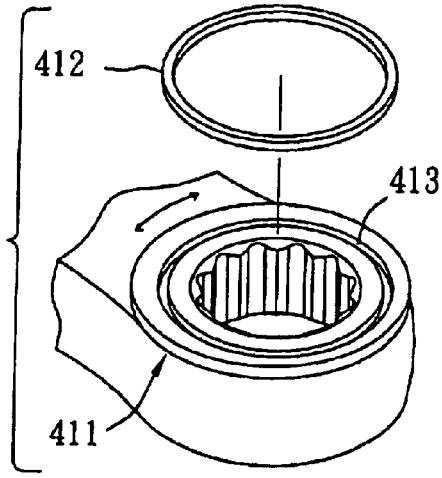
FIGS. 4(*a*)–4(*e*) show top views of turning rings dividedly with visually recognizable mechanism in accordance with the first embodiment.
Figure 4B:
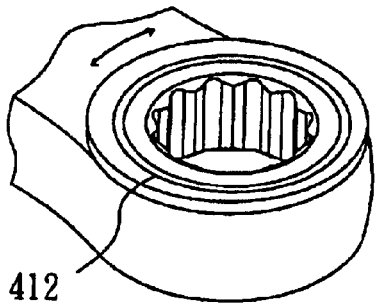
Figure 4C:
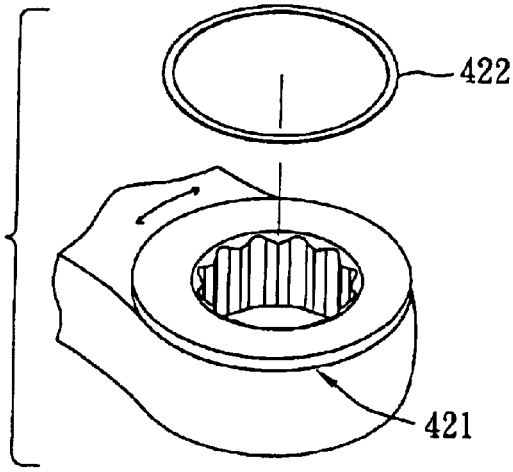
Figure 4D:
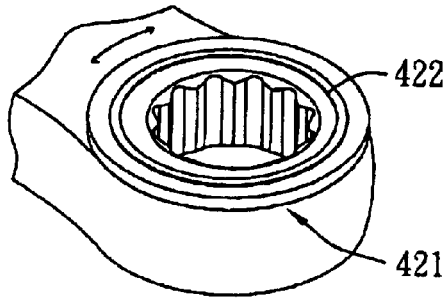
Figure 4E:
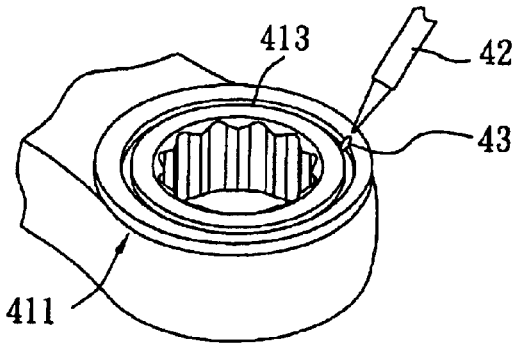
Figure 5A:
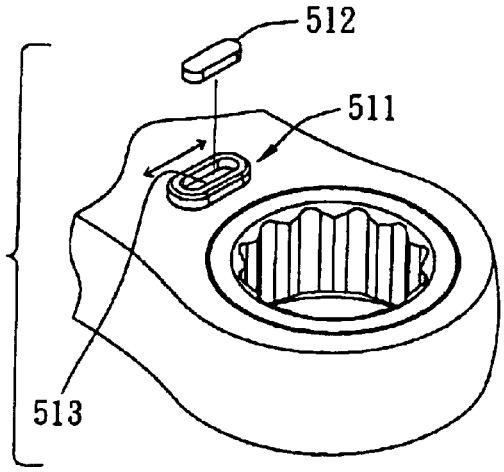
FIGS. 5(*a*)–5(*e*) show top views of direction buttons dividedly with visually recognizable mechanism in accordance with the first embodiment.
Figure 5B:
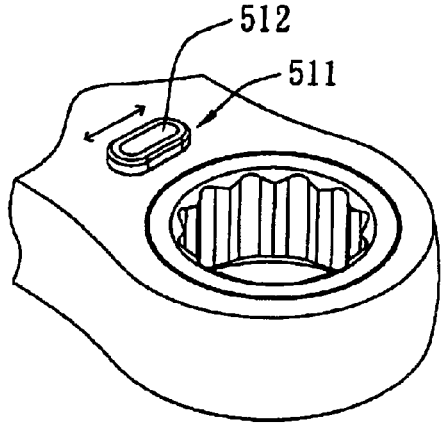
Figure 5C:
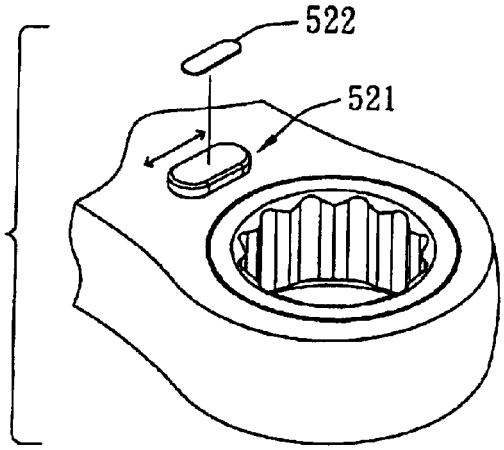
Figure 5D:
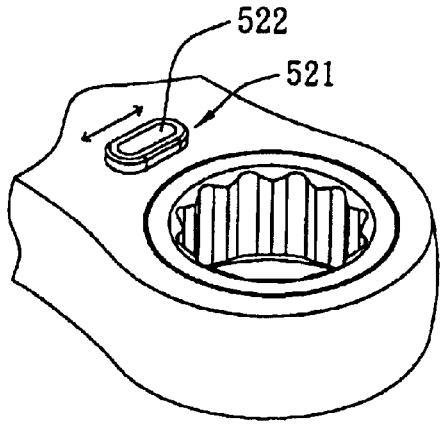
Figure 5E:
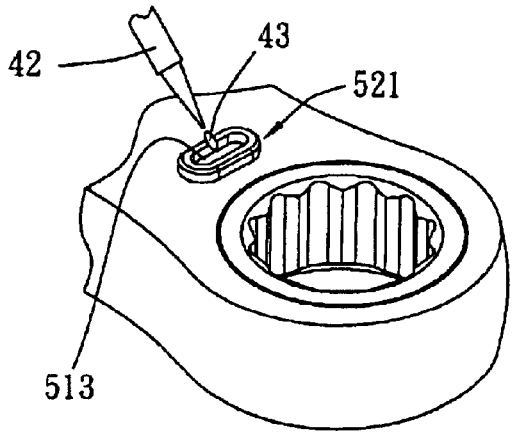
Figure 6A:
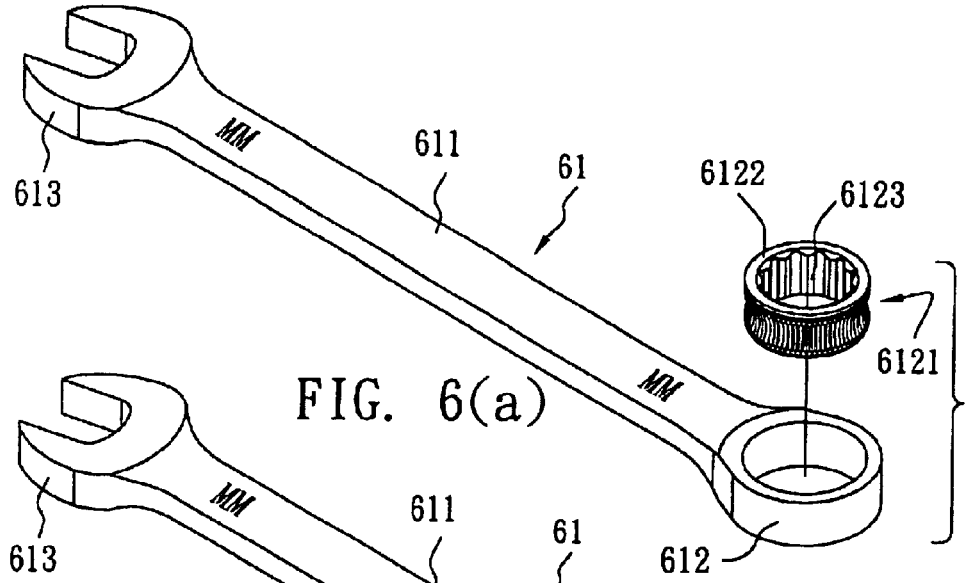
FIGS. 6(*a*)–6(*d*) are perspective diagrams of wrenches with visually recognizable mechanism in accordance with the second embodiment of the present invention.
Figure 6B:
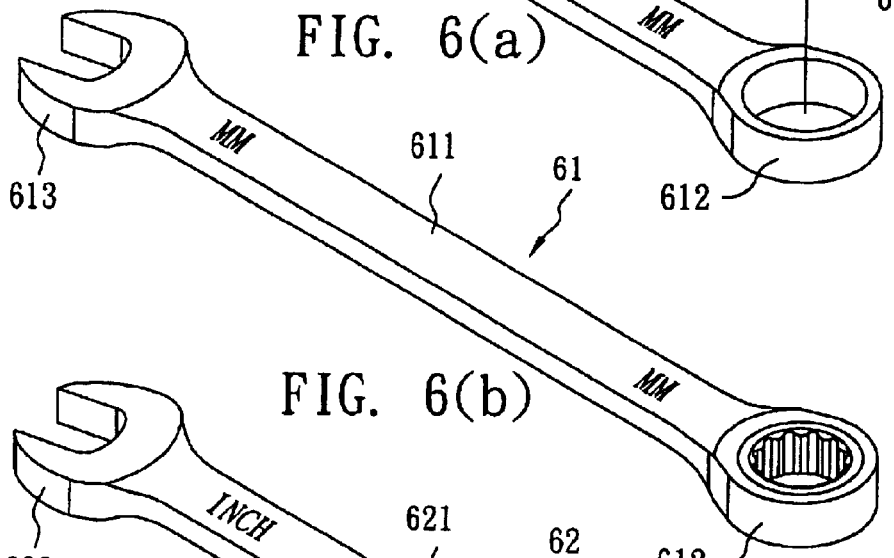
Figure 6C:
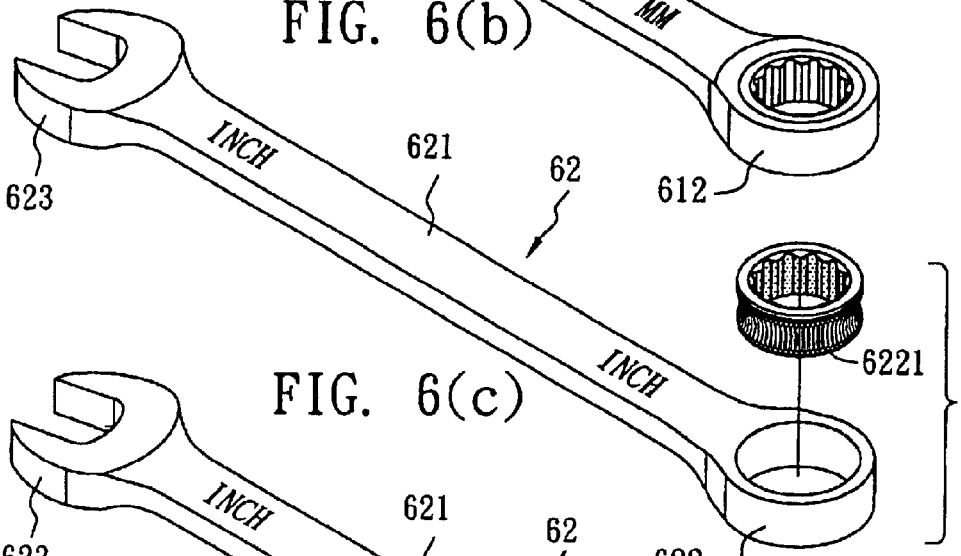
Figure 6D:
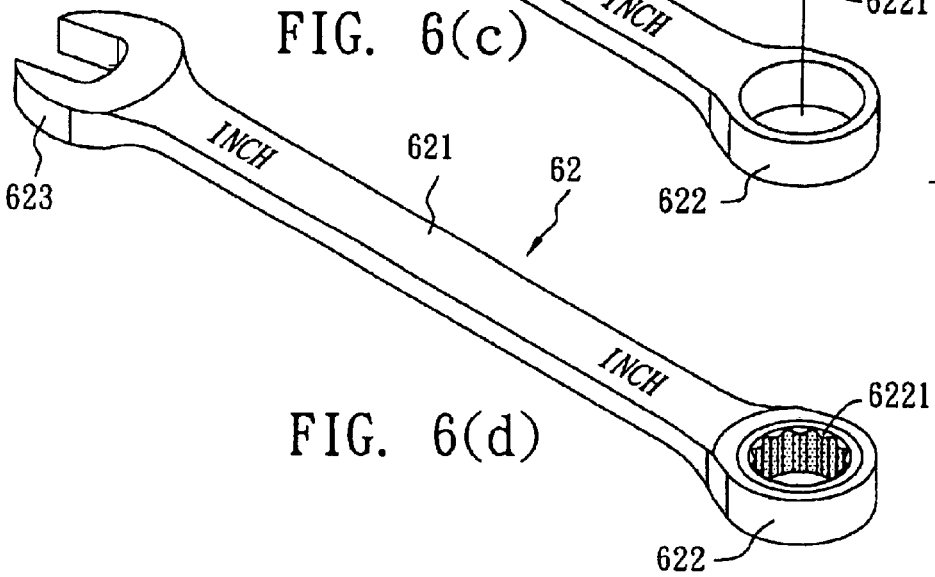

Apart from using colors for distinguishing wrenches between metric measuring system and British measuring system, we can further use various colors belonging to the same hue with differentials in levels as visually recognizable mechanisms, wherein each level represents a wrench for fastening parts with specific dimensions. As shown in FIGS. 3(*a*)–3(*c*), wrench 31 with light-red recognizable mechanism 312 can be used to turn fastening parts with 8 mm outer diameter, wrench 32 with pink recognizable mechanism 322 can be used to turn fastening parts with 9 mm outer diameter, and wrench 33 with orange recognizable mechanism 332 can be used to turn fastening parts with 10 mm outer diameter. The aforementioned recognizable mechanisms are respectively provided on the surface of direction switches 311, 321, and 331.

FIGS. 4(*a*)–4(*e*) show top views of turning wheels dividedly with visually recognizable mechanism in accordance with the first embodiment. The top surface of a turning wheel 411 is first made up of a circular groove 413, and a visually recognizable mechanism 412 in the form of a colored ring is then lodged into the circular groove 413. As shown in FIG. 4(*b*), the visually recognizable mechanism 412 can either be even with the top surface of the turning wheel 411, or be protruding over there. A display plate (or sticker) can also be used as a visually recognizable mechanism 422, which can be attached directly to the top surface of a turning wheel 411, as shown in FIGS. 4(*c*)–4(*d*). Another type of visually recognizable mechanisms, as illustrated in FIG. 4(*e*), is an automatic dispenser machine 42 dispenses coloring material 43 directly into the circular groove 413, and the coloring material 43 forms a visual recognizable mechanism once it is hardened.

FIGS. 5(*a*)–5(*e*) show top views of direction buttons dividedly with visually recognizable mechanism in accordance with the first embodiment. The top surface of direction buttons 511 is first made up of a concave 513, and a visually recognizable mechanism 512 in the form of a colored block is then lodged into the groove 513, as shown in FIG. 5(*b*). The visual recognizable mechanism 512 can either be even with the top surface of a direction button 511, or be protruding over there. We can also use a display plate (or sticker) as a visually recognizable mechanism 522, which can be attached directly onto the top surface of a direction button 521, as shown in FIG. 5(*c*)–5(*d*). Another type of visually recognizable mechanisms, as illustrated in FIG. 5(*e*), is an automatic dispenser machine 42 dispenses coloring material 43 directly into the groove 513, and the coloring material 43 forms a visually recognizable mechanism once it is hardened.

FIGS. 6(*a*)–6(*d*) are perspective diagrams of wrenches with visually recognizable mechanism in accordance with the second embodiment of the present invention. As shown in FIGS. 6(*a*)–6(*d*), wrenches 61 and 62 are of a type of combination wrenches. That is, a speed wrench head 612 and an open-end wrench head 613 are connected to both ends of the handle 611 of the wrench 61 respectively, and a speed wrench head 622 and an open-end wrench head 623 are connected to both ends of the handle 621 of the wrench 62 respectively. The speed wrench heads 612 and 622 dividedly have ratchet rings (or gear rings) 6121 and 6221 with only one rotational direction provided on their centers. The ratchet ring 6121 has two side surfaces 6122 opposite to each other and an inner surface 6123 for engaging with fastening parts. In order to effectively highlight the application of the wrench 61 for the metric measuring system and the wrench 62 for the British measuring system, visually recognizable mechanisms are separately provided on the surface of the ratcheting ring 6121 and 6221, wherein red coloring material painted on at least one of the side surfaces 6122 or on the inner surface 6123 represents the metric measuring system, and blue coloring material painted on all of or part of the surfaces of the ratchet ring 6121 represents the British measuring system. With such obvious color marks, it allows the users to quickly obtain the suitable wrenches for their jobs.

Figure 7A:
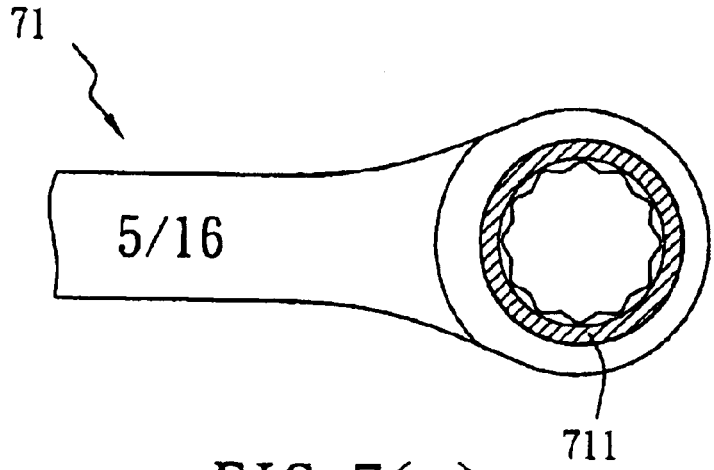
FIGS. 7(*a*)–7(*c*) show a top view of speed wrench heads in accordance with the second embodiment.
Figure 7B:
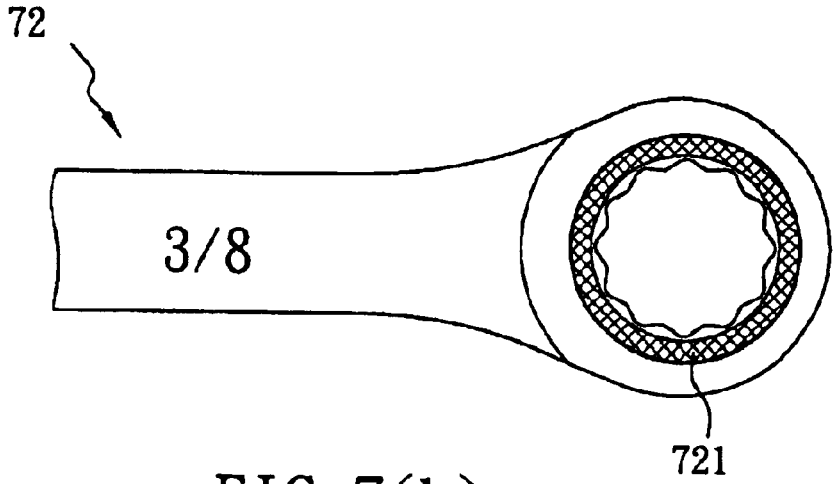
Figure 7C:
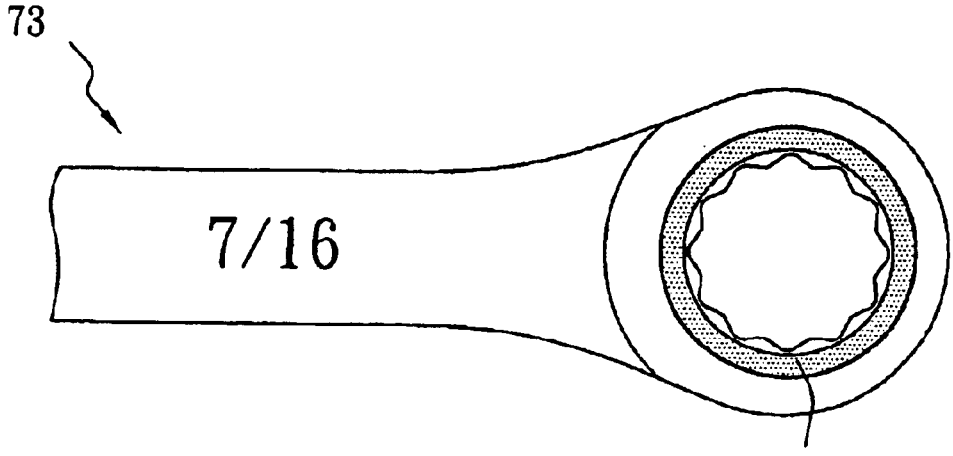

As disclosed in the first preferred embodiment, the second preferred embodiment can also use various colors belonging to the same hue with differentials in levels as visually recognizable mechanisms, wherein each level represents a wrench for fastening parts with specific dimension. As shown in FIGS. 7(*a*)–(*c*), a light blue recognizable mechanism 711 represents a wrench 71 for 5/16 inches fastening parts, a dark blue recognizable mechanism 712 represents a wrench 72 for 3/8 inches fastening parts, and a bright blue recognizable mechanism 713 represents a wrench 73 for 7/16 inches fastening parts. We can use the same rule to represent wrenches for other dimensions of fastening parts by different levels. As to the methods for marking coloring material as a visually recognizable mechanism, we can mark the ratchet rings by means of electroplating, lacquering or printing, or attach colored rings, stickers or display plates to the surfaces of the ratchet rings. In order to firmly attach the visually recognizable mechanisms to the surfaces of the wrenches, grooves are provided on the top surfaces for dispensing coloring material therein, and once the coloring material is hardened, it can form the visually recognizable mechanism. Or, having colored rings, stickers or display plates lodged in the grooves also brings significant highlighting results.

Figures 8A, 8B, 8C, 8D, 8E:
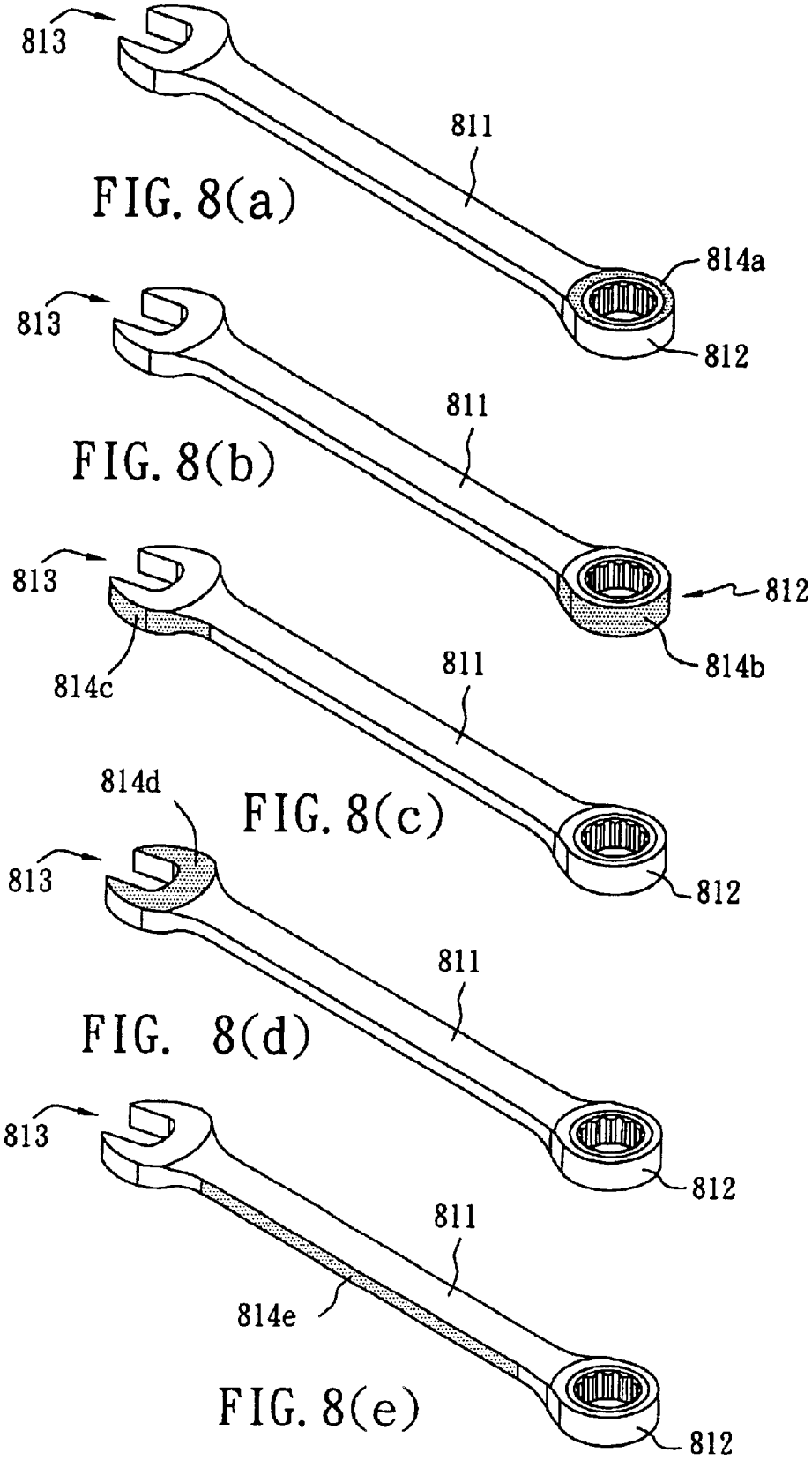
FIGS. 8(*a*)–8(*f*) are perspective diagrams of wrenches with visually recognizable mechanism in accordance with the third embodiment of the present invention.
Figure 8F:
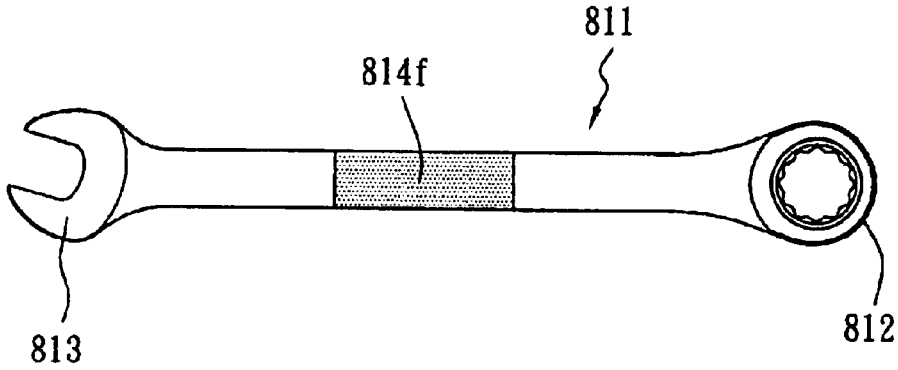

FIGS. 8(*a*)–8(*e*) are perspective diagrams of wrenches with visually recognizable mechanism in accordance with the third embodiment of the present invention. A visually recognizable mechanism 814*a* can be provided on the top or bottom surface (not shown) of a speed wrench head 812, or a visually recognizable mechanism 814*b* can be attached to the side surface of the speed wrench head 812. FIGS. 8(*c*) and 8(*d*) shows visually recognizable mechanisms 814*c* and

814*d* respectively placed on the side and top surfaces of an open-end wrench head 813 in opposition to the speed wrench head 812. A visually recognizable mechanism 814*e*, of course, can also be placed on the side surface (shown in FIG. 8(*e*)), on the top surface or the bottom surface of the handle 811 of the wrench. As shown in FIG. 8(*e*), a visually recognizable mechanism 814*f* is provided on the top and bottom surfaces of the handle 811.

The above-described embodiments of the present invention are intended to be illustrative only. Numerous alternative embodiments may be devised by persons skilled in the art without departing from the scope of the following claims.

What is claimed is:

1. A wrench with visually recognizable mechanism, comprising:

a main body;

at least one wrench head connected to one side of the main body; and a visually recognizable mechanism utilizing a color material to mark on a surface of the wrench head for recognizing classification of the wrench;

wherein the wrench head exhibits a quick reversible feature and has a directional-reversible switch, on which the visually recognizable mechanism is disposed; the visually recognizable mechanism exhibits metric and British measurements by various hues, and exhibits different dimensions of the wrenches by various hue levels.

2. A wrench with visually recognizable mechanism, comprising:

a main body;

at least one wrench head connected to one side of the main body; and a visually recognizable mechanism utilizing a color material to mark on a surface of the wrench head for recognizing classification of the wrench;

wherein the wrench head exhibits a quick reversible feature and has a turning wheel, on which the visually recognizable mechanism is disposed.

3. The wrench with visually recognizable mechanism of claim 2, wherein the visually recognizable mechanism is selected from a coloring material, a colored ring, a sticker or a display plate.

4. The wrench with visually recognizable mechanism of claim 2, wherein the turning wheel has at least one groove, on which the visually recognizable mechanism is disposed.

5. The wrench with visually recognizable mechanism of claim 4, wherein the visually recognizable mechanism is selected from a coloring material, a colored ring, a sticker or a display plate.

6. A wrench with visually recognizable mechanism, comprising:

a main body;

at least one wrench head connected to one side of the main body; and a visually recognizable mechanism utilizing a color material to mark on a surface of the wrench head for recognizing classification of the wrench;

wherein the wrench head exhibits a quick reversible feature and has a directional button, on which the visually recognizable mechanism is disposed; the visually recognizable mechanism exhibits metric and British measurements by various hues, and exhibits different dimensions of the wrenches by various hue levels.

7. The wrench with visually recognizable mechanism of claim 6, wherein the visually recognizable mechanism is selected from a coloring material, a colored ring, a sticker or a display plate.

8. The wrench with visually recognizable mechanism of claim 6, wherein the direction button has at least one concave, on which the visually recognizable mechanism is disposed.

9. The wrench with visually recognizable mechanism of claim 8, wherein the visually recognizable mechanism is selected from a coloring material, a colored ring, a sticker and a display plate.

10. A wrench with a visually recognizable mechanism, comprising:

a main body;

a wrench head on one side of the main body;

a directional-reversible switch operatively associated with the wrench head; and a visually recognizable mechanism operatively associated with the wrench head for exhibiting a hue denominating a metric or British measurement of the wrench head and a level of the hue denominating a dimension of the measurement of the wrench head.

* * * * *